US008939306B2

(12) United States Patent
Ríos

(10) Patent No.: US 8,939,306 B2
(45) Date of Patent: Jan. 27, 2015

(54) DOUBLE OPENING SYSTEM FOR BEVERAGE CANS

(76) Inventor: Ramón Tamarit Ríos, Puzol (ES)

( * ) Notice: Subject to any disclaimer, the term of this patent is extended or adjusted under 35 U.S.C. 154(b) by 927 days.

(21) Appl. No.: 13/000,718

(22) PCT Filed: Oct. 21, 2009

(86) PCT No.: PCT/ES2009/070448
§ 371 (c)(1),
(2), (4) Date: Dec. 22, 2010

(87) PCT Pub. No.: WO2010/046516
PCT Pub. Date: Apr. 29, 2010

(65) Prior Publication Data

US 2011/0108552 A1 May 12, 2011

(30) Foreign Application Priority Data

Oct. 22, 2008 (ES) ..... 200802979
Mar. 18, 2009 (ES) ..... 200900747

(51) Int. Cl.
*B65D 17/34* (2006.01)
*B65D 47/10* (2006.01)
*B65D 17/00* (2006.01)

(52) U.S. Cl.
CPC ..... *B65D 17/165* (2013.01); *B65D 2517/0092* (2013.01); *B65D 2517/0094* (2013.01)
USPC ..... 220/269; 220/270; 222/541.9

(58) Field of Classification Search
USPC ..... 220/269, 271, 265, 270, 272, 273, 220/367.1, 756, 766, 906; 222/541.1, 541.9
See application file for complete search history.

(56) References Cited

U.S. PATENT DOCUMENTS

| | | | | | |
|---|---|---|---|---|---|
| 4,872,597 | A * | 10/1989 | Hanafusa | 222/541.9 |
| 5,285,919 | A * | 2/1994 | Recchia | 220/271 |
| 5,307,947 | A * | 5/1994 | Moen et al. | 220/266 |
| 5,397,014 | A * | 3/1995 | Aydt | 220/269 |
| 5,494,184 | A * | 2/1996 | Noguchi et al. | 220/269 |
| 5,695,085 | A * | 12/1997 | Hadener | 220/269 |
| 5,819,973 | A * | 10/1998 | Traub et al. | 220/271 |
| 7,513,383 | B2 * | 4/2009 | Hwang | 220/269 |
| 2005/0173437 | A1 * | 8/2005 | Hwang | 220/271 |

FOREIGN PATENT DOCUMENTS

| | | |
|---|---|---|
| JP | 10-245032 | 9/1998 |
| WO | 2008/023983 | 2/2008 |

OTHER PUBLICATIONS

International Search Report issued Feb. 10, 2010 in International (PCT) Application No. PCT/ES2009/070448.

* cited by examiner

*Primary Examiner* — Fenn Mathew
*Assistant Examiner* — Kevin Castillo
(74) *Attorney, Agent, or Firm* — Sughrue Mion, PLLC

(57) ABSTRACT

The lid of a beverage can has two punched segments, breaking of which forms the respective openings for allowing the liquid to flow out and the air to enter. Breaking of these punched parts is performed by pivoting upwards a main ring mounted on a rivet of the lid and, after breaking open the punched part, pushing downwards a secondary lever with cutting pressure pieces which cut into the punched parts so as to cause breakage thereof. The said secondary lever is mounted on the same rivet, having an end segment which rests against a stop of the ring in order to prevent in the rest condition the pressure pieces cutting into the punched parts. In another simpler embodiment, the secondary lever is dispensed with, so that the pressure piece is incorporated along the contour of the associated main ring.

24 Claims, 11 Drawing Sheets

DOUBLE OPENING SYSTEM FOR BEVERAGE CANS

OBJECT OF THE INVENTION

The present invention, as the title of this specification states, relates to a double opening system for beverage cans for carrying out the execution of two openings in the corresponding upper lid of the beverage container or can being dealt with, with the object of allowing the exit of the liquid during its consumption and, in turn, the entrance of air for preventing the liquid to gush out messily.

Another object of the present invention is to be able to perform the opening of the orifice for the entrance of air with a minimum effort by the user, further preventing the accidental opening of that orifice for air entrance.

BACKGROUND OF THE INVENTION

Beverage containers or cans generally present an upper lid for closing the mouth, the lid having a die cut determining a weakening line for obtaining, when the time comes, a beverage discharging orifice, a rivet for fastening a ring also existing next to this die cut whose retraction carries therewith the opening, when the tilting and pressing of said ring is carried out on the die cut area, producing the ripping thereof and therefore the opening of the can is established for allowing the liquid to exit.

Clearly, the opening or orifice made in the mentioned manner, in addition to constituting the liquid exit means, also constitutes the means for air entrance, wherewith the liquid and the air collide and the liquid gushes out messily.

DESCRIPTION OF THE INVENTION

In order to achieve the objectives and avoid the drawbacks mentioned in the previous paragraphs, the invention consists of a new double opening system for beverage cans which is centred, in principle, on the fact that the ring used for carrying out the tearing of the die cut which establishes the liquid outlet orifice, is complemented with a secondary lever pivotally mounted on the same rivet which mounts the main opening ring, with the special feature that that secondary lever always actuates subsequently to the main ring, to carry out the tearing of the die cut or die cuts corresponding to the air entrance, these being distanced from the die cut corresponding to the liquid outlet, with the special feature that the main ring has a wide window for allowing the tearing lever of the die cut to be placed thereon, which will lead to the air entrance orifice, the free end of this lever being supported on a buffer provided for this purpose on the main ring, for precisely preventing that lever from not acting until the tearing of the die cut which establishes the liquid outlet orifice by means of the main ring has been carried out.

The secondary lever for tearing the die cut for the air entrance, and which is mounted on the same rivet as the main ring for tearing the die cut for liquid to exit, features one or two pointed hammers for perforating the lid, so that only a centred hammer would be desirable for the object of minimizing the user's efforts, although if not perfectly pressed in the direction perpendicular to the lid, the lever would twist without achieving tearing of the die cut, hence two hammers are arranged in a preferred embodiment, thus achieving that the lever is more stable in the pressing operation thereof to establish the orifice corresponding to the air entrance, with the possibility that one of the hammers can be blunt, so that it can only be used to stabilize the mechanism.

The die cut or die cuts which are designed to be perforated or torn by the referred to hammer or hammers, shall either be arranged centrally when being a single die cut, or on one side and another of a deep-draw which provides rigidity to the zone and thus prevents the bulge of the lid in the opening processes, in the case of there being two die cuts.

The hammer or hammers of the referred to secondary lever have a cutting profile for initiating a puncture of the die cut, and a subsequent pushing of the respective tongue for widening the initial break and increasing the orifice width.

As mentioned previously, the main ring whereby the tearing of the die cut for liquid exit is made, has a buffer for the free end of the aforementioned secondary lever, so that when the ring is pulled upward to carry out the correspondent opening during its tilting, it is dragged in tilting to the referred to lever to a point wherein this is released due to the fact that both elements (ring and lever) have different turning radii, so that when it is tilted upward from the main ring it takes the lever therewith, the lever being tilted until the end of said lever is released from the buffer established on the main ring for this purpose, whereby one side of the buffer prevents the accidental perforation of the die cuts for air entrance from being made, and on the other hand, once the tilting of the ring has been performed and the liquid outlet opening has been made, the lever can be pressed downward and its hammers can perform the corresponding opening.

The buffer provided on the main ring for preventing the lever hammers from accidentally perforating and/or tearing the die cuts which establish the air entrance orifice or orifices, can be projected either inclining upward or downward, so that in any case the upward tilting of the main lever drags the lever along therewith to a point wherein the end thereof is released from the referred to buffer, as a consequence of the different turning radii of the ring and lever.

In a variant of embodiment, said buffer can consist of a bridge lift of the end of the main ring, so that in addition to performing the buffer functions, it allows the introduction of the tip of one's finger for facilitating the pulling or upward pushing of said main ring.

The arrangement and structure of the secondary lever permits one to increase the effort of tearing the die cut which will establish the opening or orifice for air entrance. This increased effort is achieved using the lever concept, strictly speaking.

In a simpler embodiment, the secondary lever is dispensed with, so that in this case the main ring has a lower end portion which will fall on an area outlined by the die cut of the lid, executing the tearing thereof and thus releasing the air entrance orifice, after having previously released the liquid outlet orifice.

BRIEF DESCRIPTION OF THE DRAWINGS

In order to complement the description which is made below and with the object of helping towards a better understanding of the characteristics of the invention, the present specification is accompanied with a set of drawings whereby the innovations and advantages of the system made according to the object of the invention are more easily understood.

DESCRIPTION OF THE PREFERRED EMBODIMENT

Figure 1:
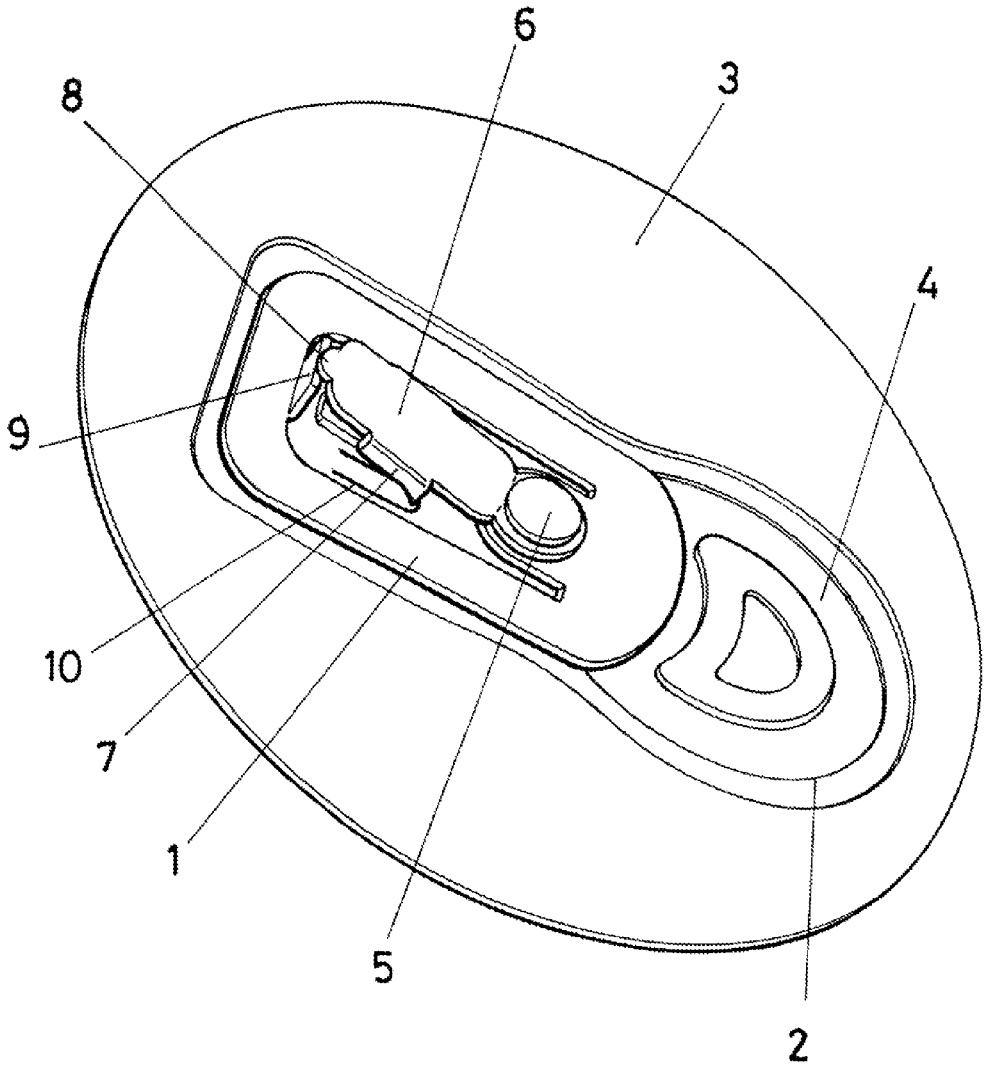
FIG. 1—Shows a representation according to an upper perspective of a beverage can or container lid, with the double opening system for beverage cans.

As can be seen from the aforementioned figures, the double opening system for beverage cans according to the object of the invention, comprises a main ring 1 wherethrough the tearing or cutting the die cut 2 is performed, established in the corresponding lid 3 of the beverage container or can, die cut 2 which delimits a tongue 4 which, upon the main ring 1 being tilted, through the rivet 5 as articulation mounting element thereof, loosens that tongue 4 towards the interior to establish the liquid outlet orifice.

Figure 3:
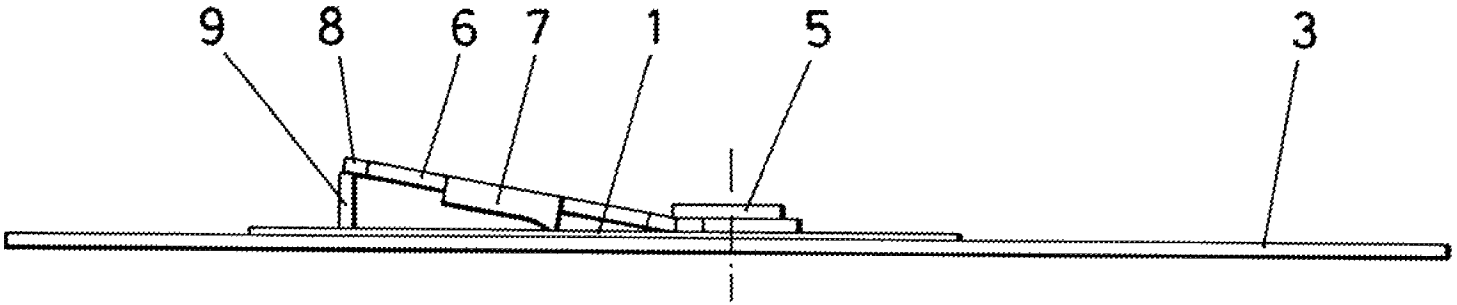
FIG. 3—Shows a sectional view of the opening system applied on the lid represented in the previous figure, in a non-operative situation.
Figure 4:
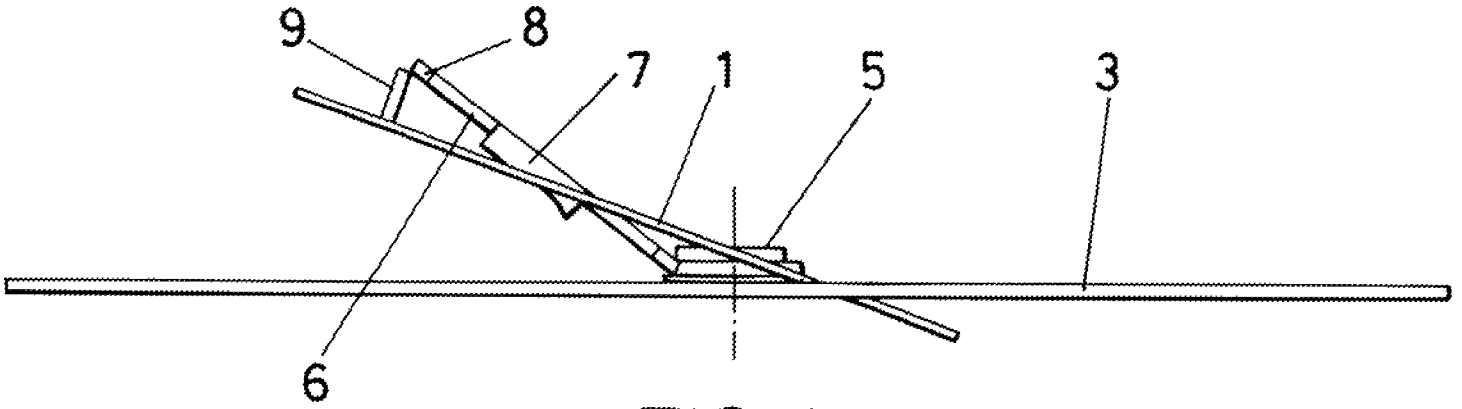
FIG. 4—Shows a sectional view such as that of the previous figure but after initiating the tilting of a main ring, dragging therewith a secondary lever, the position shown corresponding to the specific release point of said secondary lever with respect to the main ring.

On the same rivet 5 for tilting and mounting the main ring 1, a secondary lever 6 is mounted with cutting hammers 7, lever 6 which is located in a window provided for this purpose in the main ring 1, the end whereof presenting a narrower small sector 8, which rests on a buffer 9 emerging from the main ring 1, as clearly represented in FIGS. 1, 3 and 4, so that in the resting position the main ring 1, as is conventional, remains attached on the top surface of the lid 3, and the end sector 8 of the lever 6 rests on the vertical flap of the buffer 9, preventing the hammer 7 from falling on the lid 3, and specifically on die cuts 10 established on said lid 3, the breaking or tearing whereof, as explained later, carries therewith the formation of orifices for air entrance, allowing consumption of the liquid contained inside the can or container at the same time that the air enters through those orifices caused by detachment of the tongues delimited by die cuts 10, these being distant from the die cut 2 corresponding to the liquid outlet orifice, which makes it impossible for said liquid to exit through those orifices of the die cuts 10 when the consumption is carried out.

I.e., based on the proposed characteristics and solution, the main ring 1 and namely its buffer 9, block the movement of the lever 6 corresponding to the cutting hammers 7, it being necessary for the main ring 1 to carry out its upward movement to perform the breaking or tearing of the die cut 2 corresponding to the liquid outlet orifice, in whose tilting the main ring 1 drags therewith the lever 6, which will also tilt upward, pivoting on the rivet 5, until releasing that lever 6 of the ring 1, namely, from the buffer 9 thereof due to them having different turning radii, so that once the opening of the liquid outlet orifice is made, if the main ring 1 is pressed downward, the lever 6 is dragged and the hammers 7 fall on the die cuts 10 producing the tearing and the corresponding opening of the orifices to permit the entrance or air.

Figure 2:
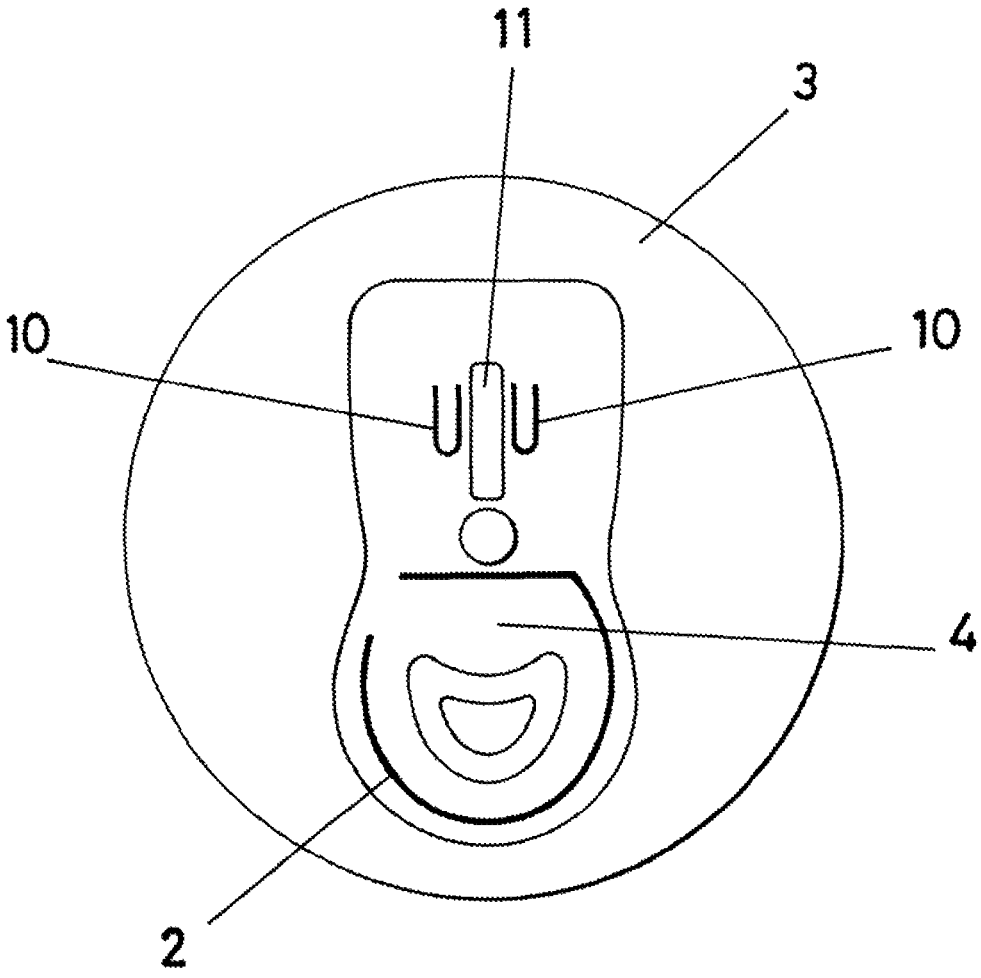
FIG. 2—Shows a plan view of the lid wherein the double opening system of the invention is applicable, and in whose lid the die cuts are made for both the opening of a liquid outlet orifice and air entrance openings.

Between the die cuts 10 and to give a greater consistency to that area of the lid, a deep-draw 11 has been provided, as represented in FIG. 2.

Figure 5:
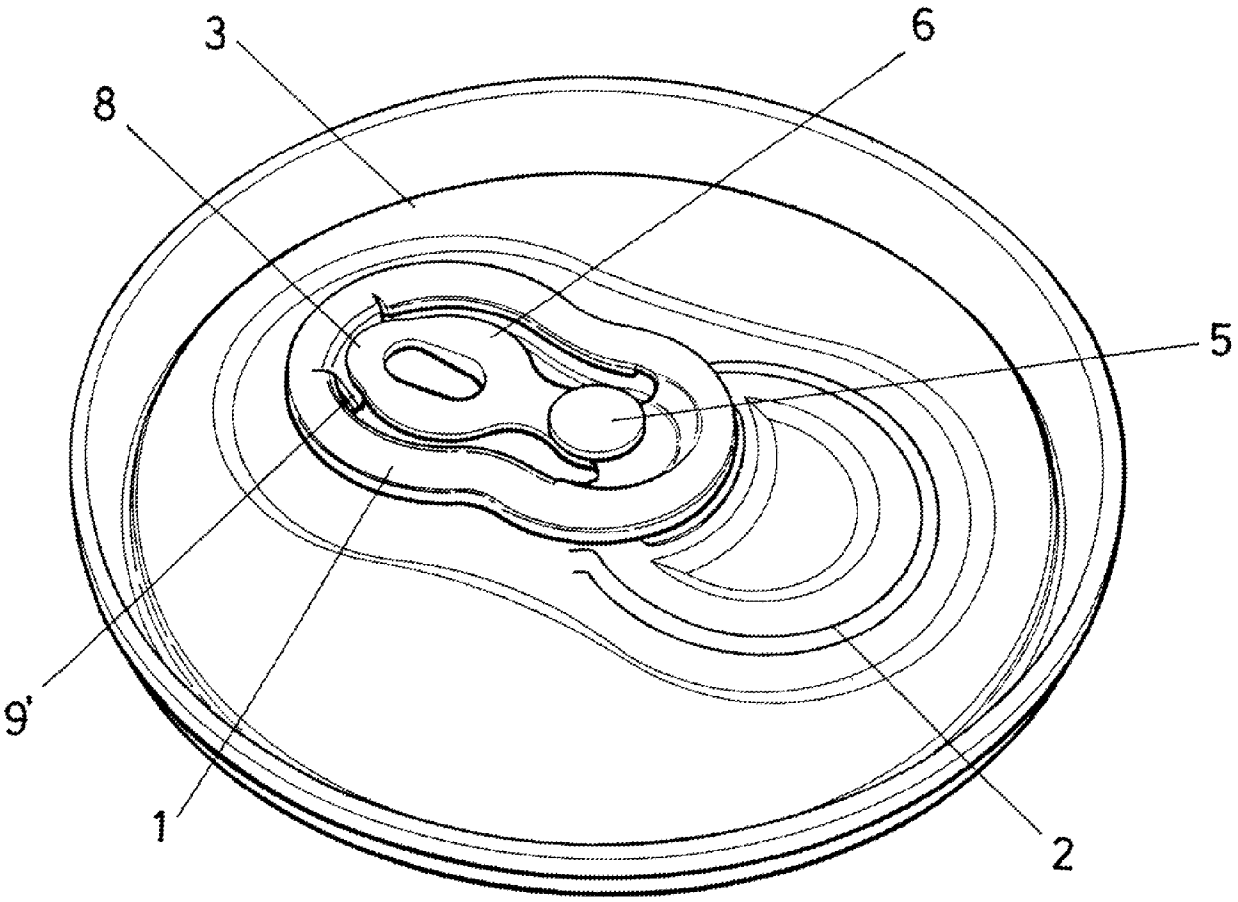
FIG. 5—Shows a representation such as that from FIG. 1, in a variant of embodiment of the shape or design of the double opening system, wherein a buffer of the main ring is projected inclining downward.
Figure 6:
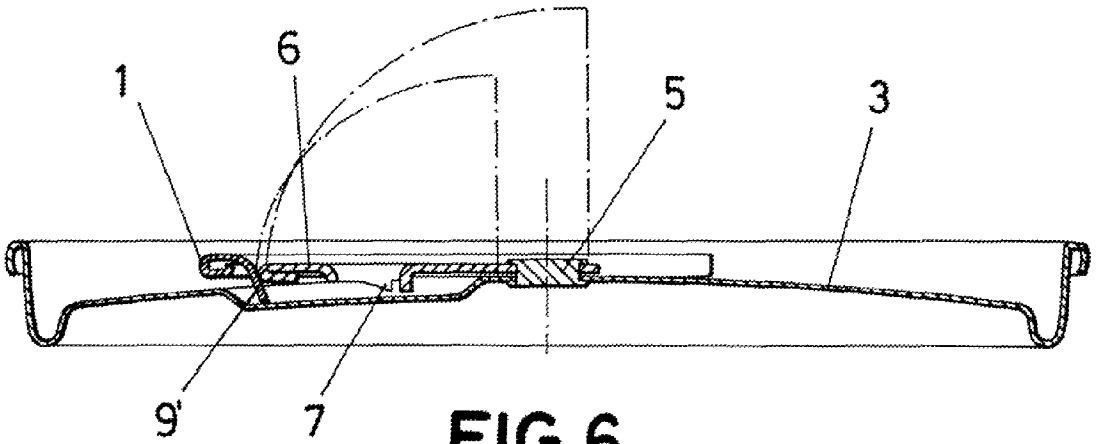
FIG. 6—Shows a sectional view such as the one from FIG. 3, but with a buffer of the main ring projected downward, according to the embodiment of the previous figure.
Figure 7:
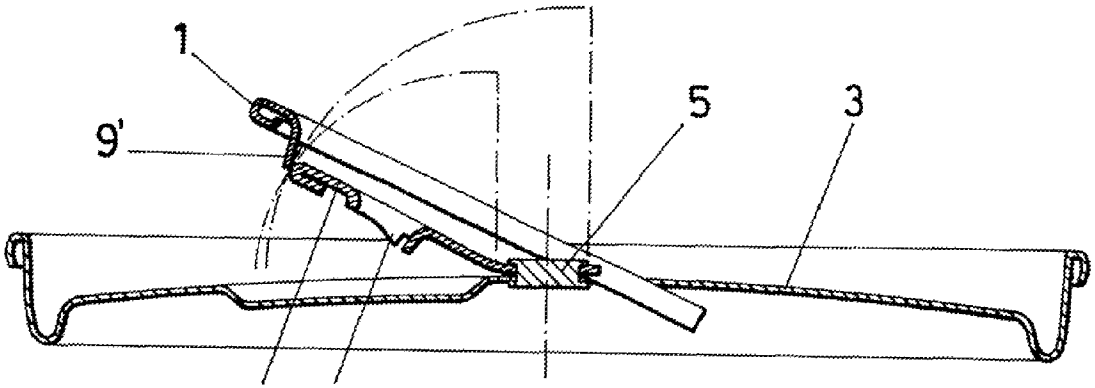
FIG. 7—Shows a view equivalent to that of FIG. 4, but with the version of the buffer represented in FIGS. 5 and 6.
Figure 8:
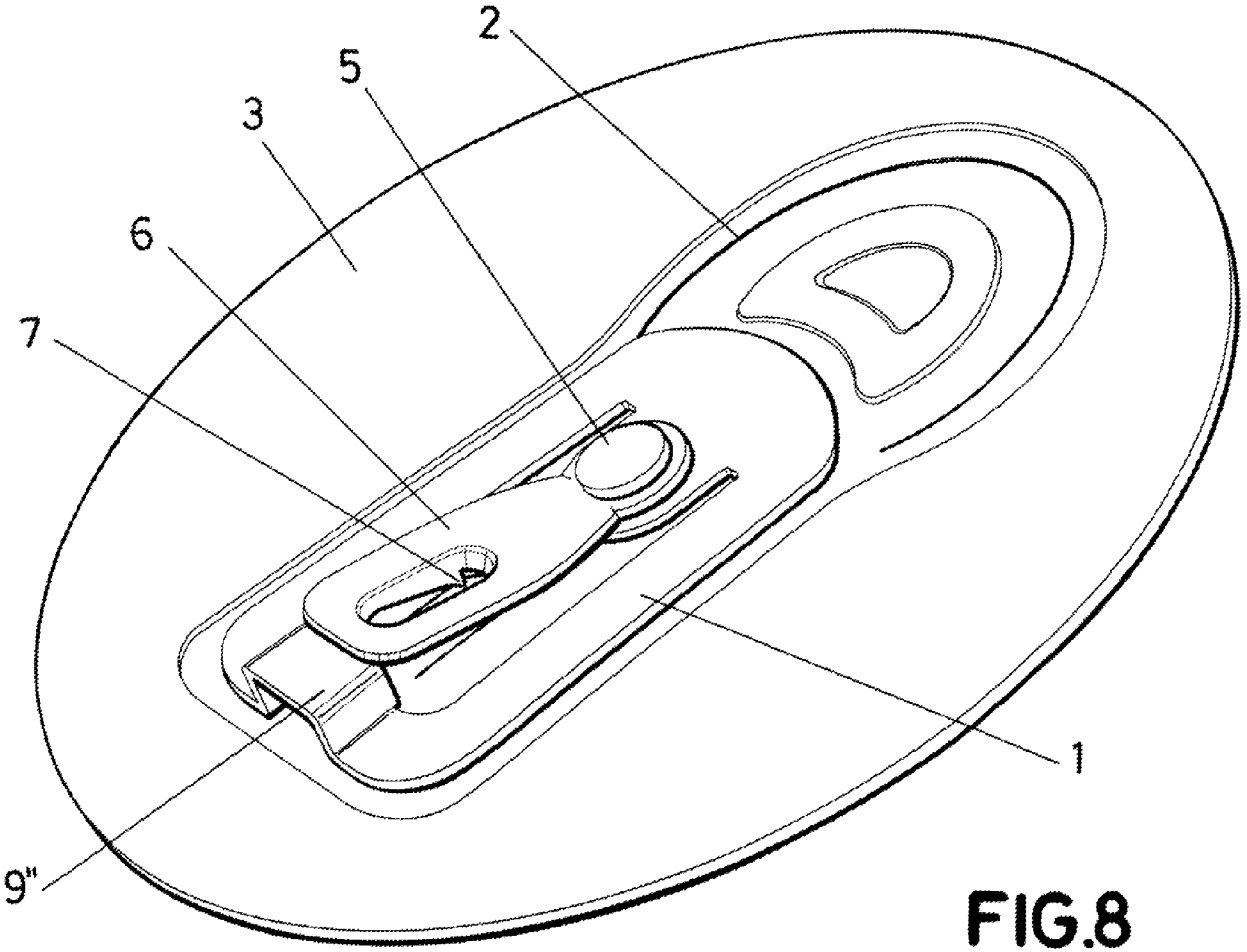
FIG. 8—Shows a representation such as that from FIG. 1, wherein the secondary lever has a window, and the buffer of the main ring for said secondary lever consists of a bridge lift.

In FIGS. 5, 6 and 7, a variant of embodiment of the buffer for the end sector 8 of the lever 6 is shown, so that in this case, said buffer is formed by a flap 9' projected downward in an inclined manner, in order to constitute a ramp for the end edge of the end sector 8 which will initially retain this and therefore the lever 9' until the release is produced in the upward tilting of the main ring 1 as can be seen in FIG. 6, which shows the rotating or tilting point wherein the aforementioned release is precisely produced. In this variant of embodiment, the secondary lever 6 remains arranged practically horizontally, as can be observed in FIG. 6, with less risk of being accidentally actuated or pressed. Additionally, it can be seen in FIG. 5 how the design is different from the previous figures, since the main ring 1 has a double lobe shape and a big window, whereas the secondary lever 6 is ovally widened and is also provided with a window.

The secondary lever for making the opening of the orifices for air entrance may be made of aluminium, or even of a stamped iron strip, featuring a pre-fold at 10° directly above the rivet 5, wherein the section for ensuring the folded axis has been reduced, while the hammers 7 of said lever 6 are bent at 90° with respect to the upper face of the lever 6.

Finally, it must be said that the buffer for the secondary lever 6, instead of being formed by a flap, it is determined by a bridge lift 9" established at the end of the main ring 1, permitting the positioning of the finger end below said bridge lift 9" to facilitate the actuation or push upwards of said main ring 1 in the opening operation of the can or beverage container being dealt with.

Figure 9:
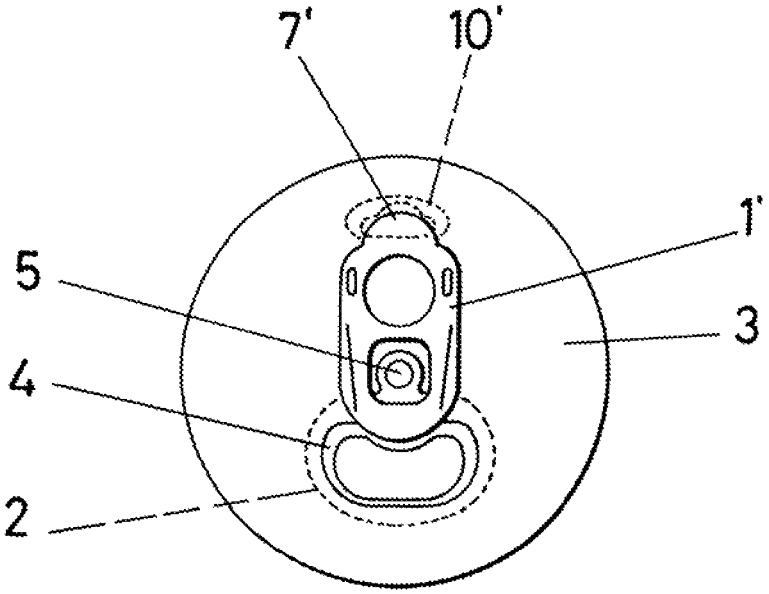
FIG. 9—Shows a plan view of a beverage can lid with a double opening system which is simpler than the one represented in the previous figures.
Figure 10:
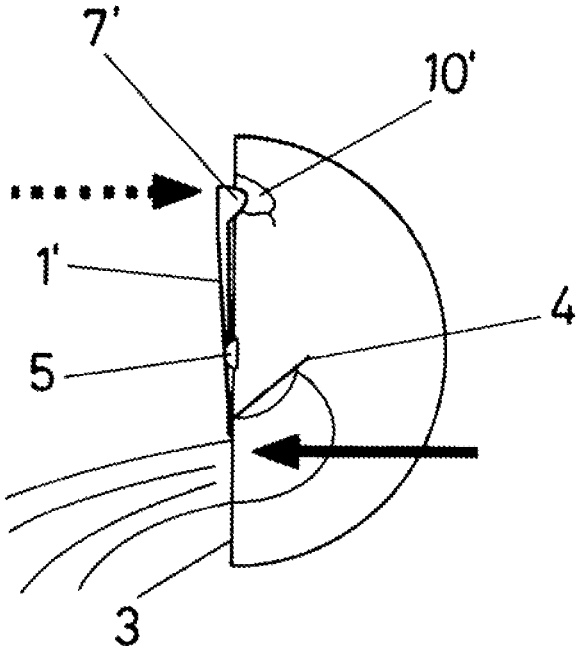
FIG. 10—Shows an elevational view of that represented in the previous figure.
Figure 11:
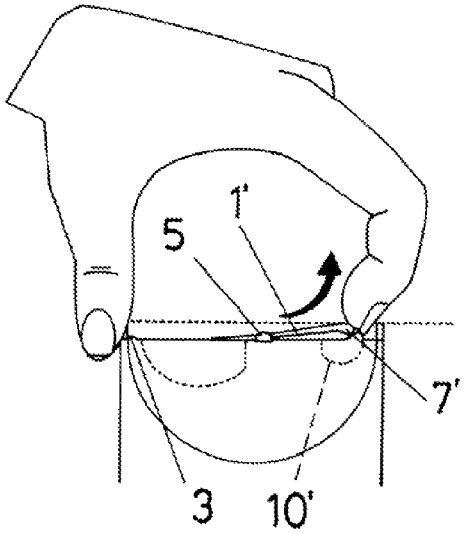
FIGS. 11 to 13—Show respective views of the opening process of a can corresponding to the double opening system shown in FIGS. 9 and 10.
Figure 12:
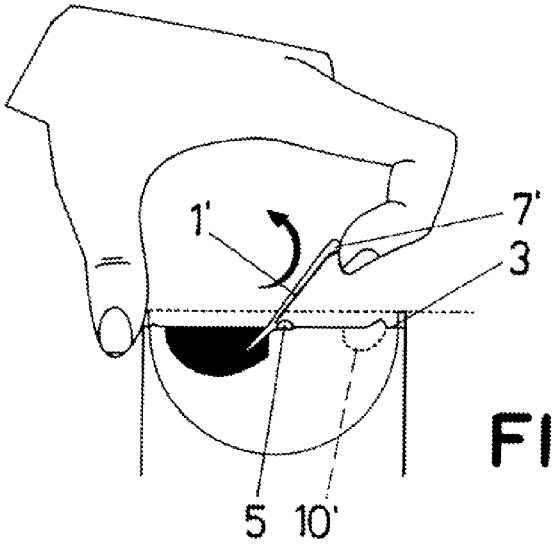
Figure 13:
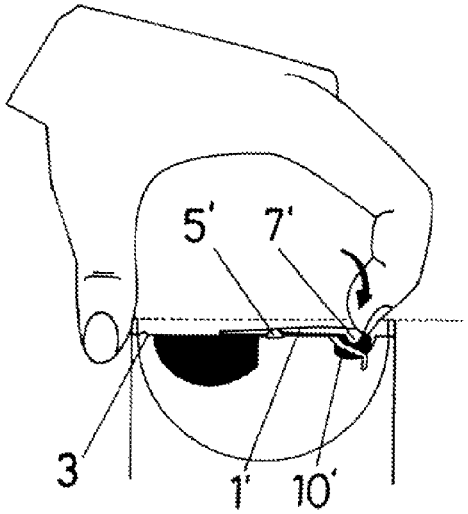

In FIGS. 9 and 10 a simpler embodiment is shown, although less advantageous than that shown in the previous figures.

In said embodiment, the main ring 1' lacks the secondary lever 6, so that in this case said main ring 1' has a lower end portion in the form of hammer 7' directed downward which will fall on the area of the lid outlined by the die cut 10' producing the tearing and corresponding opening of the orifice to allow the entrance of air.

As in the previously described embodiment, in the case of the simple embodiment (FIGS. 9 to 13), the tearing of the die cut 10' is performed after having tilted the main ring 1' upward to release the liquid outlet orifice, tearing which outlines the tongue 4, so that upon tilting the main ring 1' downward again until reaching its initial position and pressing on the end thereof, the lower end portion of the hammer 7' of said main ring 1', said hammer will fall on the area delimited by the aforementioned die cut 10', producing its tearing and therefore the opening of the air entrance orifice.

Figure 14:
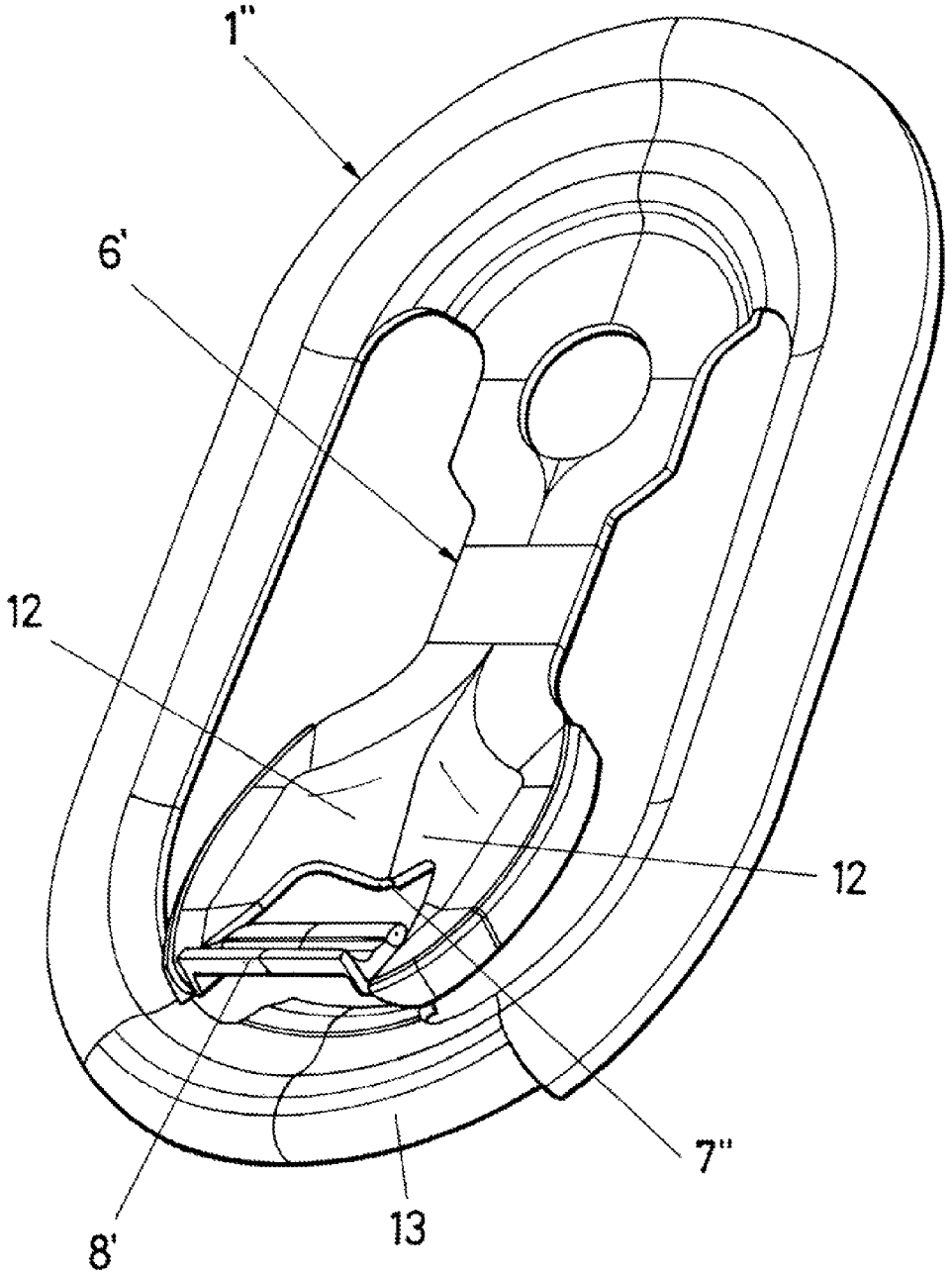
FIGS. 14 to 16—Show perspective views of a double opening system for beverage cans different from those shown in the previous figures.
Figure 15:
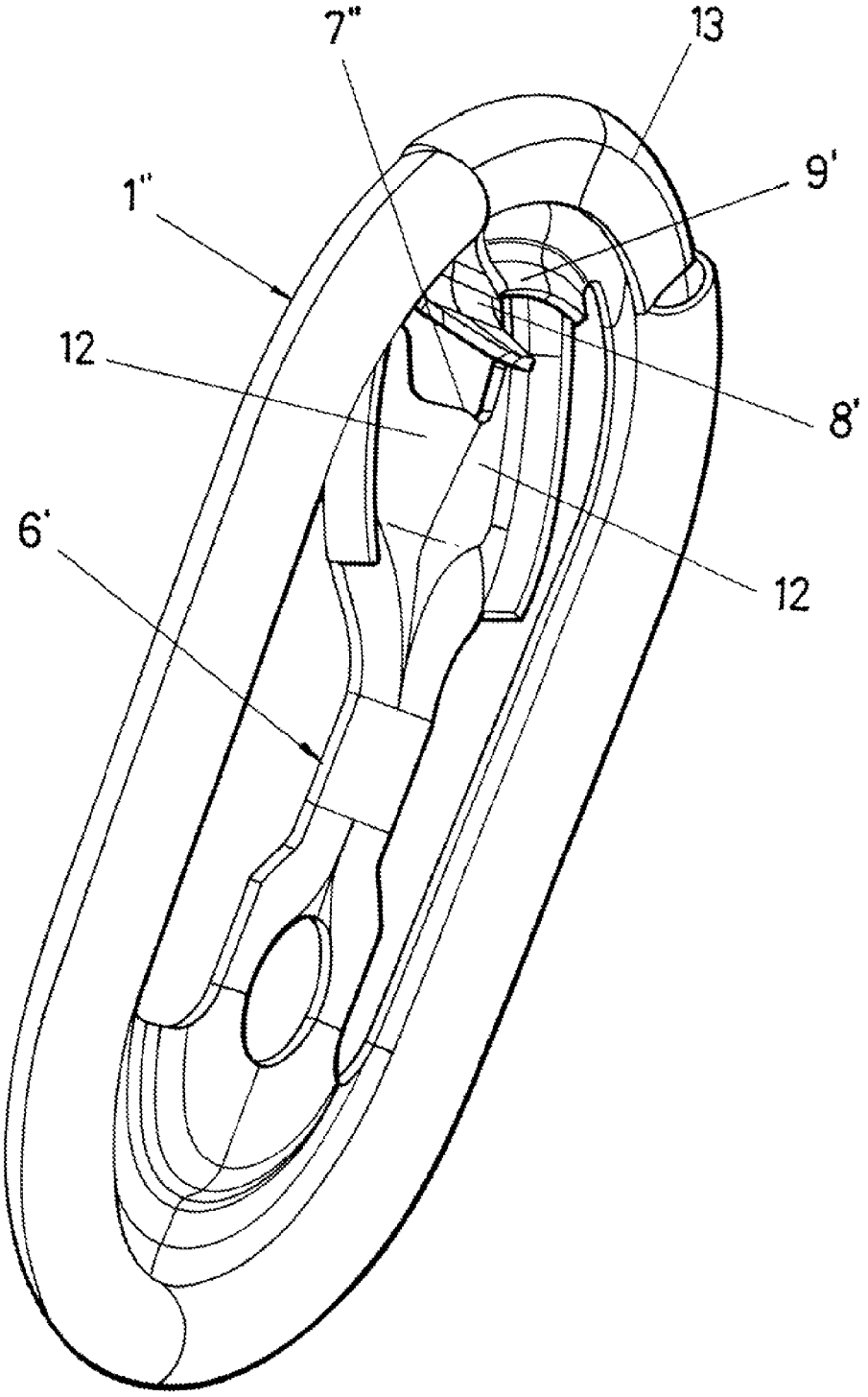

In FIGS. 14 and 15 a third, more advantageous embodiment is shown wherein, starting from the embodiment shown in FIGS. 1 to 8, a secondary lever 6' is incorporated which has a central folding characteristic 12 formed by two downward converging planes which delimit a low relief projection constituting the corresponding hammer 7" facing a die cut unit 10" whose breaking determines the air entrance orifice. The secondary lever 6' also incorporates a characteristic angular configuration end sector 8', whereon the buffer 9' of the main ring 1" will fall.

In turn, the outline delimited by the main ring 1" features a characteristic peripheral thickening of more ergonomic rounded cross-section, whose continuity is interrupted by a narrow portion 13 which facilitates the initiation of the lifting of the main ring 1".

Figure 16:
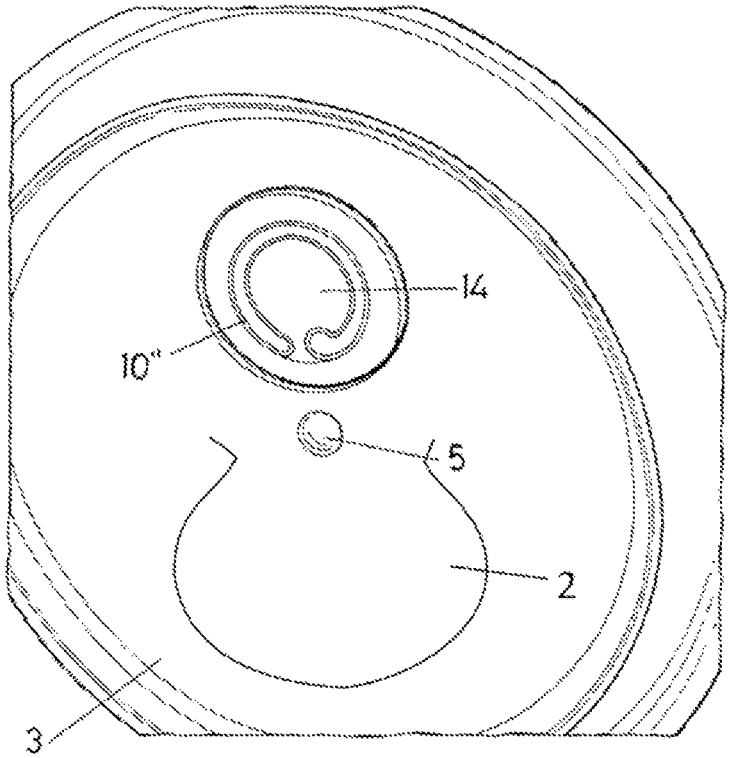

In FIG. 16, a characteristic bulge 14 in the shape of spherical cap delimited for the die cut 10" is shown, corresponding to the air entrance inside the can.

Nevertheless, this bulge is also applicable to the die cuts 10-10' of the other two embodiments.

The invention claimed is:

1. A double opening system for a beverage can, wherein a corresponding lid of the beverage can features a first die cut configured to be torn so as to establish a liquid outlet orifice for liquid contained in the can, the tearing of the first die cut being performed by an upward tilting about a tilting axis of a main ring mounted on a rivet on the lid; wherein the lid incorporates at least a second die cut whose tearing constitutes an air entrance orifice, the second die cut delimits a portion of the lid facing a cutting hammer formed on a secondary lever and configured to tear the second die cut after tilting the main ring downward until the main ring reaches an initial resting position, after having first torn the liquid outlet orifice; and wherein the secondary lever is mounted with the same rivet as the main ring but has a tilting axis different from the tilting axis of the main ring; said secondary lever configured to move the cutting hammer for tearing the second die cut by pressing downwards on said secondary lever after tilting the main ring upwards and tearing the first die cut and wherein the cutting hammer is provided on said secondary lever.

2. The double opening system, according to claim 1, characterised in that the secondary lever for tearing of the second die cut features an end sector which determines a support on a buffer established on the main ring to prevent the cutting hammer from falling on the second die cut before performing the tilting of the main ring to carry out the tearing of the first die cut.

3. The double opening system, according to claim 2, characterised in that the main ring is provided with a wide locating window for the secondary lever.

4. The double opening system, according to claim 2, characterised in that the different tilting axes of the main ring and the secondary ring is such that the tilting of the main ring to perform the tearing of the first die cut initially drags the secondary lever until the end sector is released from the buffer of said main ring, while in the downward tilting of said main ring after the tearing of the first die cut, the downward dragging of the second lever is taken along, producing, in the pressing thereof on the lid, the tearing of the second die cut by the cutting hammer of said secondary lever.

5. The double opening system, according to claim 2, characterised in that the buffer for the end sector of the secondary lever, is formed by an upwards projecting flap.

6. The double opening system, according to claim 2, characterised in that the buffer for the end sector of the secondary lever is formed by a downward tilting flap, establishing a support ramp and buffer for said end sector.

7. The double opening system, according to claim 2, characterised in that the buffer for the end sector of the secondary lever is formed by a bridge lift corresponding to the end of the main ring.

8. The double opening system, according to claim 2, characterised in that the end sector of the secondary lever comprises a small extension which is a prolongation of the secondary lever.

9. The double opening system, according to claim 2, characterised in that the end sector of the secondary lever features an angular configuration.

10. The double opening system, according to claim 1, characterised in that the secondary lever has a centred fold forming two downward converging planes which delimit a centred low relief end projection which constitutes the hammer.

11. The double opening system, according to claim 1, characterised in that the main ring features a peripheral thickening of rounded cross-section which is interrupted by a narrow portion.

12. The double opening system, according to claim 1, characterised in that the area delimited by the second die cut comprises a bulge.

13. The double opening system, according to claim 12, characterised in that the bulge features a structure in the shape of a spherical cap.

14. The double opening system, according to claim 3, characterised in that the tilting axis of the main ring (1-1") is different from the tilting axis of the secondary ring (6-6'), so that the tilting of the main ring (1-1") to perform the tearing of the die cut (2) initially drags the secondary lever (6-6') until the end sector (8-8') is released from the buffer (9 or 9' or 9") of said main ring (1), while in the downward tilting of said main ring (1) after the tearing of the die de cut (2), the downward dragging of the second lever (6-6') is taken with it, producing, in the pressing thereof on the lid (3), the tearing of the die cut or die cuts (10) by the cutting hammer or hammers (7-7") of said secondary lever (6-6').

15. The double opening system, according to claim 3, characterised in that the buffer for the narrow end sector of the secondary lever, is formed by an upwards projecting flap.

16. The double opening system, according to claim 4, characterised in that the buffer for the narrow end sector of the secondary lever, is formed by an upwards projecting flap.

17. The double opening system, according to claim 3, characterised in that the buffer for the end sector of the secondary lever is formed by a downward tilting flap, establishing a support ramp and buffer for said end sector.

18. The double opening system according to claim 1, wherein the secondary lever and main ring are an integral one-piece construction.

19. A double opening system for a beverage can, comprising a lid, the lid comprising a first die cut that defines a first opening in the lid when the first die cut is torn and a second die cut that defines a second opening in the lid when the second die cut is torn; a first lever attached to the lid by a coupling and configured to pivot about a first axis so as to tear the first die cut; a second lever attached to the lid by the same coupling and configured to pivot about a second axis so as to tear the second die cut, wherein the second axis is spaced from the first axis so that upon pivoting of the first lever and the second lever, and end of the first lever traces a first arc and an end of the second lever traces a second arc, the first arc and the second arc being nonconcentric and on a same side of a vertical axis passing through the coupling; wherein the second lever comprises a downward facing hammer configured to tear the second die cut when pressed into the second die cut.

20. The double opening system of claim 19, wherein the coupling is a rivet.

21. The double opening system of claim 19, wherein the second lever is pulled upwards with the first lever at one end when pivoting the first lever to tear open the first opening.

22. The double opening system of claim 19, wherein the first lever and the second lever form a one-piece integral construction.

23. The double opening system of claim 19, wherein the first die cut and the second die cut are disposed on opposite sides of the coupling.

24. The double opening system of claim 19, wherein the second lever is blocked from tearing the second die cut until the first lever is pivoted about the first axis.

* * * * *